US006056391A

United States Patent [19]

Kasamoto et al.

[11] Patent Number: 6,056,391

[45] Date of Patent: May 2, 2000

[54] SUBSTRATE HAVING LAYERED ELECTRODE STRUCTURE FOR USE IN INK JET HEAD, INK JET HEAD, INK JET PEN, AND INK JET APPARATUS

[75] Inventors: Masami Kasamoto, Ayase; Toshihiro Mori, Yokohama, both of Japan

[73] Assignee: Canon Kabushiki Kaisha, Tokyo, Japan

[21] Appl. No.: 08/411,890

[22] Filed: Mar. 28, 1995

[30] Foreign Application Priority Data

Mar. 29, 1994 [JP] Japan ..... 6-058534

[51] Int. Cl.[7] ..... B41J 2/05

[52] U.S. Cl. ..... 347/58

[58] Field of Search ..... 347/58, 50, 56, 347/57, 59, 64

[56] References Cited

U.S. PATENT DOCUMENTS

| | | | |
|---|---|---|---|
| 4,458,256 | 7/1984 | Shirato et al. | 347/58 |
| 4,866,460 | 9/1989 | Shiozaka | 347/58 |
| 4,947,191 | 8/1990 | Nozawa et al. | 347/30 |
| 5,006,867 | 4/1991 | Koizumi et al. | 347/17 |
| 5,081,474 | 1/1992 | Shibata et al. | 347/59 |
| 5,420,623 | 5/1995 | Tamura | 347/58 |

FOREIGN PATENT DOCUMENTS 6-28272 4/1994 Japan .

OTHER PUBLICATIONS

Lewis, Hawley's Condensed Chemical Dictionary, 12thed, 1993.

*Primary Examiner*—N. Le
*Assistant Examiner*—Judy Nguyen
*Attorney, Agent, or Firm*—Fitzpatrick, Cella, Harper & Scinto

[57] ABSTRACT

A substrate for an ink jet head comprises a base member and an electrothermal converting body formed on the base member, the electrothermal converting body including a resistor layer and a pair of electrode layers connected to the resistor layer wherein the resistor layer positioned between a pair of the electrode layers serves as a heat generating portion for generating thermal energy utilized for discharging ink; wherein one of a pair of the electrode layers passes under the heat generating portion; an electrode layer positioned under the heat generating portion has a multi-layer structure composed of a plurality of layers; and at least one of a plurality of the layers, being nearest to the heat generating portion, is made of a metal having a melting point of 1500° C. or more at 1 atm. An ink jet head using this substrate is able to prolong service life while reducing a failure ratio, and to continue preferable ink discharge for a long period of time.

30 Claims, 7 Drawing Sheets

SUBSTRATE HAVING LAYERED ELECTRODE STRUCTURE FOR USE IN INK JET HEAD, INK JET HEAD, INK JET PEN, AND INK JET APPARATUS

BACKGROUND OF THE INVENTION

1. Field of the Invention

The present invention relates to a substrate constituting an ink jet head for recording, printing or the like (hereinafter, referred to typically as "recording") characters, symbols, images or the like (hereinafter, referred to typically as "images") by discharging ink functional liquid or the like (hereinafter, referred to typically as "ink") on a record holding body including a paper sheet, a plastic sheet, a piece of cloth, and an article (hereinafter, referred to typically as "paper"); an ink jet head using the substrate; an ink jet pen including an ink reservoir for reserving ink to be supplied to the ink jet head; and an ink jet apparatus for mounting the ink jet head.

In the present invention, the ink jet pen includes a cartridge form having an ink reservoir integrated with an ink jet head, and it further includes another form in which an ink jet head and an ink jet reservoir are separately prepared and are removably combined with each other. The ink jet pen is removably mounted on a mounting means such as a carriage of an apparatus main body. In the present invention, the ink jet apparatus includes a form integrally or separately provided on information processing equipment such as a word processor or a computer as an output terminal, and it further includes another form used for a copying machine in combination with information reading equipment or the like, a facsimile having an information transmitting/receiving function, a machine for performing textile printing on cloth, and the like.

2. Description of the Related Background Art

An ink jet apparatus has a feature capable of recording a highly precise image at a high speed by discharging ink from a discharge opening as small droplets at a high speed. In particular, an ink jet apparatus of a type, in which an electrothermal converting body is used as an energy generating means for generating energy utilized for discharging ink and ink is discharged by use of a bubble generated in ink by a thermal energy produced by the electrothermal converting body, is excellent in performances such as high precision of image, high speed recording, and reduction in sizes of a head and the apparatus. In recent years, there have been strong demands of markets towards these performances of the ink jet apparatus, and to meet the demands, various attempts have been made to improve the ink jet apparatus.

One of such attempts for improving the ink jet apparatus is disclosed in U.S. Pat. No. 4,458,256. In this reference, as shown in FIG. 11, for example, return portions of electrodes for imparting electric energy to heat generating portions (hereinafter, in some cases, referred to as "heaters") of resistors constituting electrothermal converting bodies are made common as a common lead electrode, and the common lead electrode is provided to lie as a conductive layer under an insulating layer. With this construction, a plurality of heaters can be arranged to be closer to each other as compared with the conventional manner because they are not interrupted by the return portions of the electrodes. Ink passages communicated to discharge openings are provided to correspond to the heaters. Accordingly, a higher density arrangement of the ink passages can be achieved, leading to a higher density arrangement of the discharge openings, thus obtaining a higher precise image. The higher density arrangement of the ink passages also contributes to saving in space, to thereby further reduce the size of the head.

Examined Japanese Utility Model Publication No. HEI 6-28272 also discloses a construction in which a metal layer as a common lead electrode is provided under a heating resistor layer by way of an under-coat layer. As the material of the metal layer, there are mentioned tantalum, molybdenum, tungsten or the like.

The present inventors have examined the above-described ink jet heads, and found that they have undoubtedly various advantages described above, but they present the following problems; namely, the above-described ink jet heads are possibly shortened in service life contrary to the expectation or are possibly reduced in discharge performance during discharge of ink.

With respect to the cause of the above problems, the present inventors have examined, and found the fact that, for the common lead electrode made of aluminum, a stress concentration region having a projecting shape called a "hillock" is possibly formed on the surface of the common lead electrode due to the thermal effect. In particular, the temperature of a portion near the common lead electrode under the heater instantaneously reaches the melting point of a metal material constituting the common lead electrode due to a high heat energy generated by the heater. Such stress concentration in the common lead electrode acts to accelerate the growth of the hillock, or to generate a new hillock. The generation of hillocks is sequentially propagated upwardly by way of various layers, with a result that a projecting portion having a height of, for example about 2 $\mu$m is formed on the bubbling surface of the heater. In such a projecting portion on the bubbling surface, a step portion (corner portion) where the film quality is weakened is concentratedly damaged by the effects of a large variation in pressure and thermal stress generated on the bubbling surface (these effect are called "cavitation") due to the repeated bubbling in the ink passage, and finally ink permeates through the step portion and causes electric corrosion, resulting in the disconnection of the resistor. This brings a failure of the ink jet head, and shortens the service lief contrary to the expectation. Moreover, a strain appearing in the form of the projecting portion on the bubbling surface is increased as the hillock is grown, which gradually exerts adverse effect on the bubbling phenomenon; consequently the discharge performance is reduced during discharge of ink.

The results of the examination on the above-described problem also showed the following point as one of the causes, though there have been an unclear phenomenon. In the case where the common lead electrode is made of tantalum, molybdenum, tungsten or the like as in Examined Japanese Utility Model Publication No. HEI 6-28272, since the resistivity of such a metal is relatively large, the heat generated by the metal itself is accumulated in the head in addition to the heat generated by the heater during discharge of ink. By the effect of the heat thus accumulated, it becomes gradually difficult to keep the thermal control and to keep the normal bubbling phenomenon on the bubbling surface. As a result, the discharge performance is dropped during discharge of ink. This problem significantly emerges in the case that the interval between the heaters is shortened for achieving a higher density arrangement and thus the heat becomes easier to be accumulated, or that the ink jet head is driven at a higher speed and thus the heat becomes easier to be accumulated.

SUMMARY OF THE INVENTION

An object of the present invention is to solve the above-described problems, and to provide a substrate constituting an ink jet head capable of prolonging service life by reducing a failure ratio, and an ink jet head using the substrate.

Another object of the present invention is to provide a substrate constituting an ink jet head capable of continuing preferable discharge of ink for a long period of time, and an ink jet head using the substrate.

A further object of the present invention is to provide a substrate for an ink jet head provided with a plurality of discharge openings arranged in a high density for recording a high precise image at a high speed, and an ink jet head using the substrate.

Still a further object of the present invention is to provide a substrate for constituting an ink jet head reduced in cost by saving a space of a base member made of a relatively expensive material such as a single crystal silicon, and an ink jet head using the substrate.

An even further object of the present invention is to provide an ink jet pen including an ink reservoir for reserving an ink to be supplied to the above-described ink jet head, and an ink jet apparatus for mounting the ink jet head.

According to a first aspect of the present invention, there is provided a substrate for an ink jet head comprising a base member and an electrothermal converting body formed on the base member, the electrothermal converting body including a resistor layer and a pair of electrode layers connected to the resistor layer wherein the resistor layer positioned between a pair of the electrode layers serves as a heat generating portion for generating thermal energy utilized for discharging ink;

wherein one of a pair of the electrode layers passes under the heat generating portion; an electrode layer positioned under the heat generating portion has a multi-layer structure composed of a plurality of layers; and at lest one of a plurality of the layers, being nearest to the heat generating portion, is made of a metal having a melting point of 1500° C. or more at 1 atm.

According to a second aspect of the present invention, there is provided an ink jet head comprising:

a substrate for an ink jet head, including a base member and an electrothermal converting body formed on the base member, the electrothermal converting body including a resistor layer and a pair of electrode layers connected to the resistor layer wherein the resistor layer positioned between a pair of the electrode layers serves as a heat generating portion for generating thermal energy utilized for discharging ink;

an ink path disposed to correspond to the heat generating portion; and a discharge opening for discharging ink, which is disposed to be communicated to the ink path;

wherein one of a pair of the electrode layers passes under the heat generating portion; an electrode layer positioned under the heat generating portion has a multi-layer structure composed of a plurality of layers; and at least one of a plurality of the layers, being nearest to the heat generating portion, is made of a metal having a melting point of 1500° C. or more at 1 atm.

According to a third aspect of the present invention, there is provided an ink jet pen comprising:

an ink jet head including: a substrate for an ink jet head which has a base member and an electrothermal converting body formed on the base member, the electrothermal converting body including a resistor layer and a pair of electrode layers connected to the resistor layer wherein the resistor layer positioned between a pair of the electrode layers serves as a heat generating portion for generating thermal energy utilized for discharging ink; an ink path disposed to correspond to the heat generating portion; and a discharge opening for discharging ink, which is disposed to be communicated to the ink path; and an ink reservoir for reserving ink to be supplied to the ink path;

wherein one of a pair of the electrode layers passes under the heat generating portion; an electrode layer positioned under the heat generating portion has a multi-layer structure composed of a plurality of layers; and at least one of a plurality of the layers, being nearest to the heat generating portion, is made of a metal having a melting point of 1500° C. or more at 1 atm.

According to a fourth aspect of the present invention, there is provided an ink jet apparatus comprising:

an ink jet head including: a substrate for an ink jet head which has a based member and an electrothermal converting body formed on the base member, the electrothermal converting body including a resistor layer and a pair of electrode layers connected to the resistor layer wherein the resistor layer positioned between a pair of the electrode layers serves as a heat generating portion for generating thermal energy utilized for discharging ink; an ink path disposed to correspond to the heat generating portion; and a discharge opening for discharging ink, which is disposed to be communicated to the ink path; and a means for mounting the ink jet head;

wherein one of a pair of the electrode layers passes under the heat generating portion; an electrode layer positioned under the heat generating portion has a multi-layer structure composed of a plurality of layers; and at least one of a plurality of the layers, being nearest to the heat generating portion, is made of a metal having a melting point of 1500° C. or more at 1 atm.

The above and other objects, effects, features, and advantages of the present invention will become more apparent from the following description of embodiments thereof taken in conjunction with the accompanying drawings.

DESCRIPTION OF THE PREFERRED EMBODIMENTS

The present inventors have obtained the knowledge that the above-described problems can be solved by a method wherein an electrode under a heater is constituted of a multi-layer structure having a plurality of layers and at least the uppermost layer thereof is formed of a high melting point metal. On the basis of the knowledge, the present invention has been accomplished. Specifically, an electrode under a heater most susceptible to the heat generated by a heater is constituted of a multi-layer structure having a plurality of layers which can function complementarily to each other. Of a plurality of the layers, the ones on the lower side are formed of a common electrode material having a larger electric conductivity for reducing a power loss; while at least the uppermost one is formed of a high melting point metal. The uppermost layer functions to diffuse the heat and to lower the thermal effect, and nevertheless the layer itself is not affected by the thermal effect. This is effective to prevent or suppress the generation of a hillock, and hence to prevent or suppress the formation of a projecting portion on a bubbling surface.

As the material for forming the electrode portion other than the high melting point metal layer according to the present invention, a material commonly used as an electrode material in this field can be adopted; however, a metal having a melting point of not less than 1500° C. at 1 atm is preferable. For example, Al, Cu Al—Si alloy and Al—Cu alloy are preferable, and Al is most preferable in the total characteristics. In this specification, the term "metal" includes "metal element" and "alloy", and also it includes a pure metal containing no impurity and a metal containing impurities.

As the high melting point metal used in the present invention, a metal having a melting point of 1500° C. or more at 1 atm is preferable, and a metal having a melting point of 2500° C. or more at 1 atm is most preferable. For example, Ta, W, Cr, Ti, Mo, an alloy containing two or more metals selected from a group consisting of Ta, W, Cr, Ti, and Mo, and an alloy containing at least one metal selected from a group consisting of Ta, W, Cr, Ti and Mo are preferable. Of these metals, Ta is most preferable.

In the present invention, the high melting point metal layer is preferably formed to be applied with a compressive stress for suppressing the generation of stress concentration on the electrode under the heater, thereby further preventing the generation of a hillock. The compressive stress applied to the high melting point metal layer is preferable in the range from $1\times10^{7}$ to $1\times10^{12}$ dyn/cm$^2$, more preferably, in the range from $1\times10^{9}$ to $1\times10^{10}$ dyn/cm$^2$.

Figure 1A:
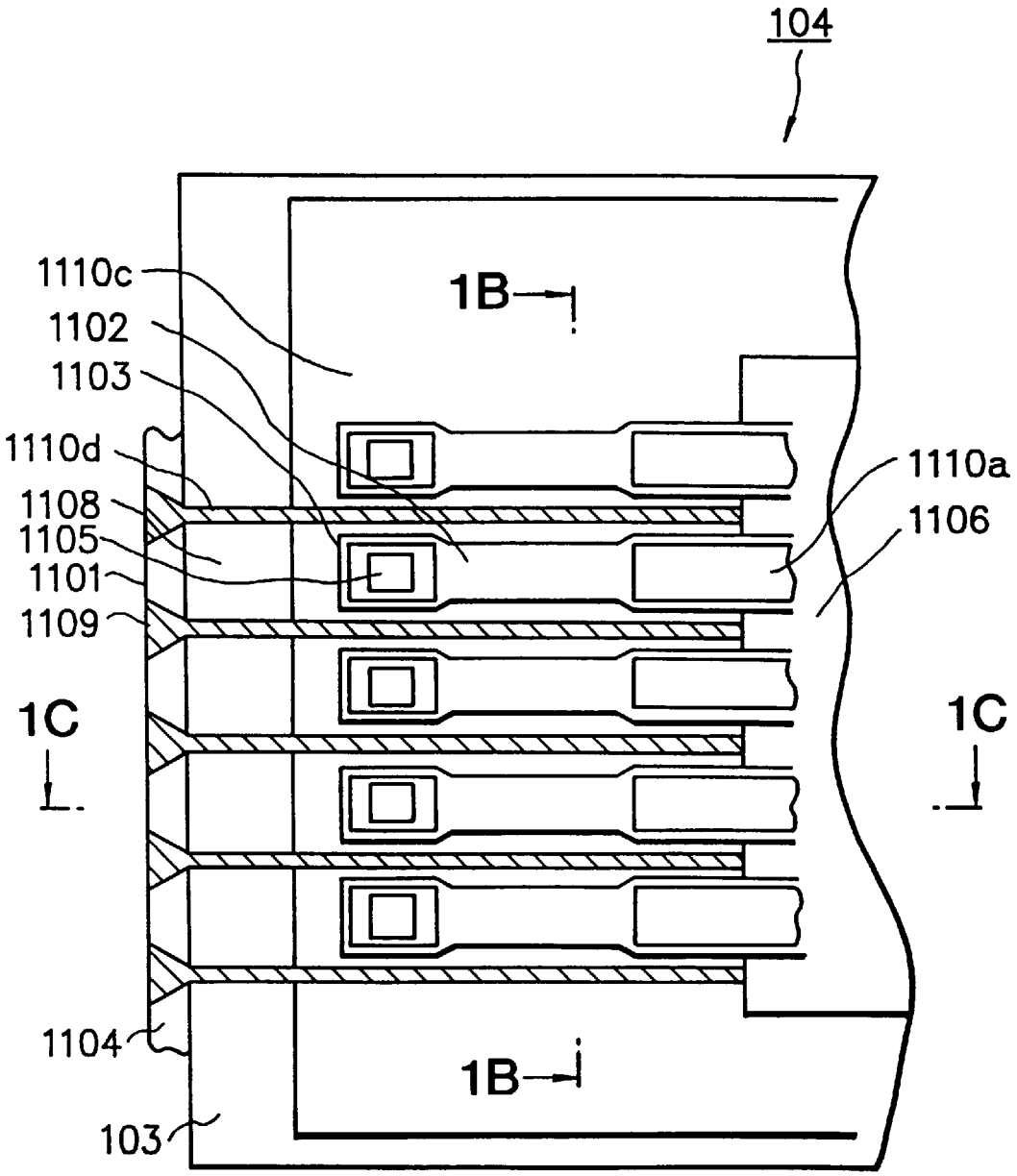
FIG. 1A is a schematic sectional view seen from the upper side of heaters, showing a main portion of one embodiment of an ink jet head according to the present invention.
Figure 1B:
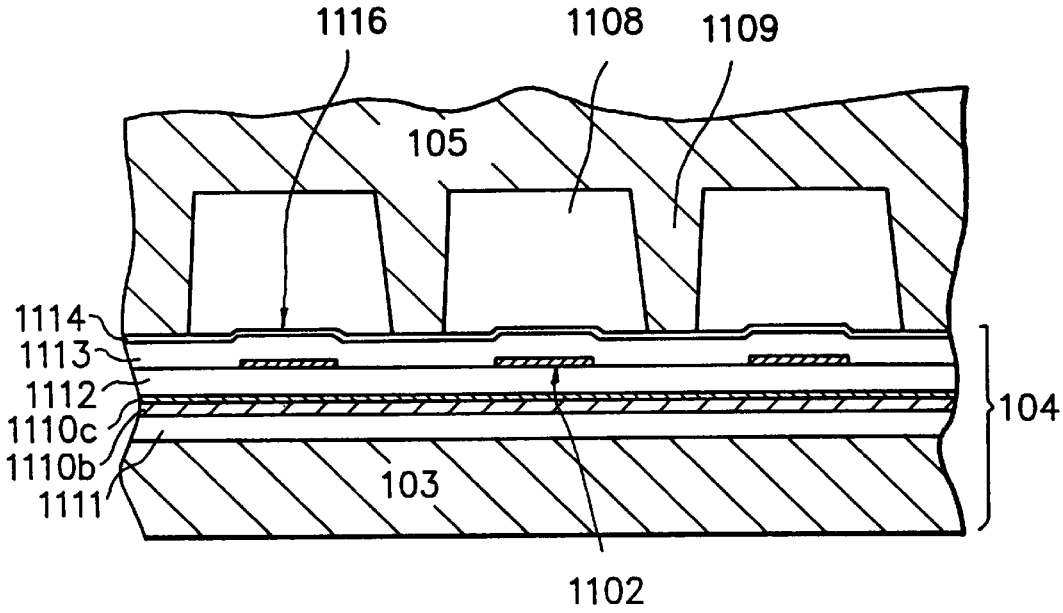
FIG. 1B is a schematic sectional view taken along line A-A' of FIG. 1A, showing the main portion of the ink jet head.
Figure 1C:
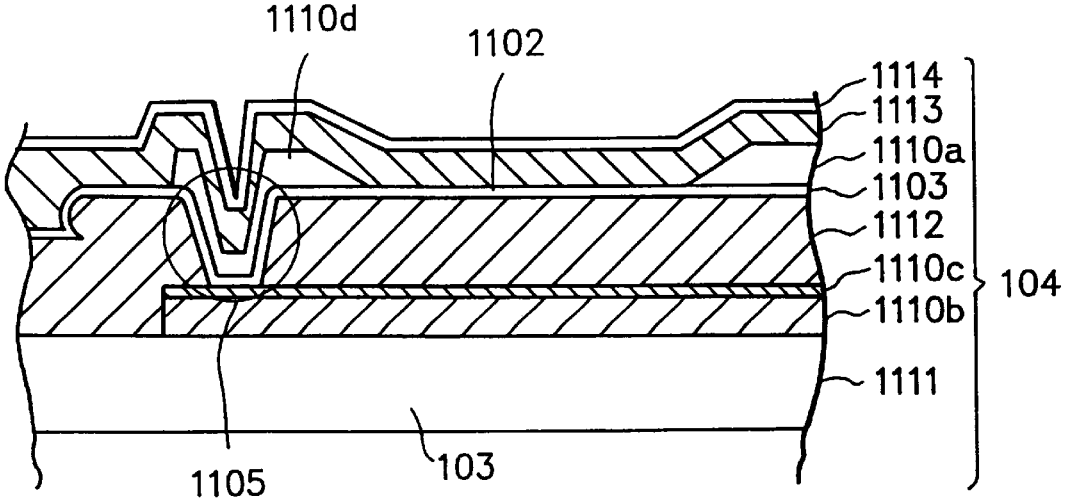
FIG. 1C is a schematic sectional view taken along line B-B' of FIG. 1A, showing the main portion of the ink jet head.

FIG. 1A is a schematic sectional view seen from the upper side of heaters, showing a main portion of one embodiment of an ink jet head according to the present invention. FIG. 1B is a schematic sectional view taken along line A-A' of the main portion of the ink jet head shown in FIG. 1A, and FIG. 1C is a schematic sectional view taken along line B-B' of the main portion of the ink jet head shown in FIG. 1A.

The ink jet head of this embodiment is provided with a plurality of discharge openings 1101. An heat generating portion (heater) 1102 of an electrothermal converting body for generating energy utilized for discharging ink from each discharge opening 1101, is provided for each ink path 108 communicated to the discharge opening 1101. The electrothermal converting body has a resistor layer 1103 containing the heat generating portion 1102 and an electrode for supplying electric energy to the resistor layer 1103. The electrode includes an individual electrode layer 1110*a*, a connection electrode layer 1110*d*, and a common lead electrode layer. The common lead electrode layer has a multi-layer structure including an upper electrode layer 1110*c* and a lower electrode layer 1110*b*, and which is not individually separated but is formed in a flat shape.

The above common lead electrode layer having a multi-layer structure is formed on a base member 103 by way of a lower insulating layer 1111. An upper insulating layer 1112 is provided on the common lead electrode layer, and through-holes 1105 are formed to be patterned on the upper insulating layer 1112 at specified portions. The resistor layers 1103, individual electrode layer 1110*a* and the connection electrode layer 1110*d* are formed to be patterned on the upper insulating layer 1112. The connection electrode layer 1110*d* is connected to the common lead electrode layer by way of the resistor layer 1103 at the through-hole 1105.

The resistor layer 1103, individual electrode layer 1110*a* and connection electrode layer 1110*d* are covered with a lower protective layer 1113 and an upper protective layer 1114. The substrate 104 for an ink jet head in this embodiment includes the base member 103 and the above-described various thin film layers formed on the base member 103.

The ink jet paths 1108 are partitioned from each other by path wall members 1109. The end portion of the ink path 1108 on the side opposite to the discharge opening 1101 is communicated to a common ink chamber 1106. Ink supplied from an ink tank for reserving ink is temporarily reserved in the common ink chamber 1106. The ink supplied in the common ink chamber 1106 is introduced in each ink path 1108, and is held in the state that meniscus is formed at the discharge opening 1101. When the electrothermal converting body is selectively driven for generating heat, the ink is film-boiled, to thus form a bubble. Based on the growth of such a bubble, the ink is discharged from the discharge opening 1101.

In the ink jet head according to this embodiment, among a plurality of the layers constituting the common lead electrode layer, the upper electrode layer 1110*c* is formed of a high melting point metal. According to the construction of this substrate for an ink jet head, with respect to the electrode positioned under the heat generating portion 1102 and being most susceptible to the heat generated by the heat generating portion 1102, at least the uppermost layer (upper electrode layer 1110C) is made of a high melting point metal, and the high melting point metal layer functions to diffuse the heat and to lower the thermal effect and nevertheless the layer itself is not affected by the heat. Accordingly, it becomes possible to prevent or suppress the generation of a hillock, and hence to prevent or suppress the generation of a projecting portion on the bubbling surface.

Moreover, since the return portions of the electrodes are made common as a wide conductive layer, voltage drop can be prevented or suppressed, as compared with the case where they are individually provided for heaters.

The substrate for an ink jet head according to this embodiment can be manufactured by adopting a film formation technique used in manufacture of semiconductors. First, the surface of the base member 103 made of single crystal silicon is made insulating by forming a lower insulating layer 1111 composed of a film of an inorganic material such as silicon oxide or silicon nitride on the base member 103 by using the known film formation technique. Subsequently, a film of Al or the like as the lower electrode layer and a film of a high melting point metal such as Ta as the upper electrode layer are sequentially formed on the insulating surface of the base member 103, for example by continuous sputtering, thus forming the material layers for the common lead electrode layer having a multi-layer structure. In this case, the high melting point metal layer is preferably formed to be applied with a compressive stress by adjusting argon pressure upon the continuous sputtering. Next, a plurality of the material layers for the common lead electrode layer are simultaneously patterned, to thus form the common lead electrode layer. In FIG. 1A, the patterning is performed in a wide and flat shape. The manufacture of the substrate for an ink jet head after formation of the upper insulating layer 1112 is similarly performed by using the known film formation technique.

Figure 4A:
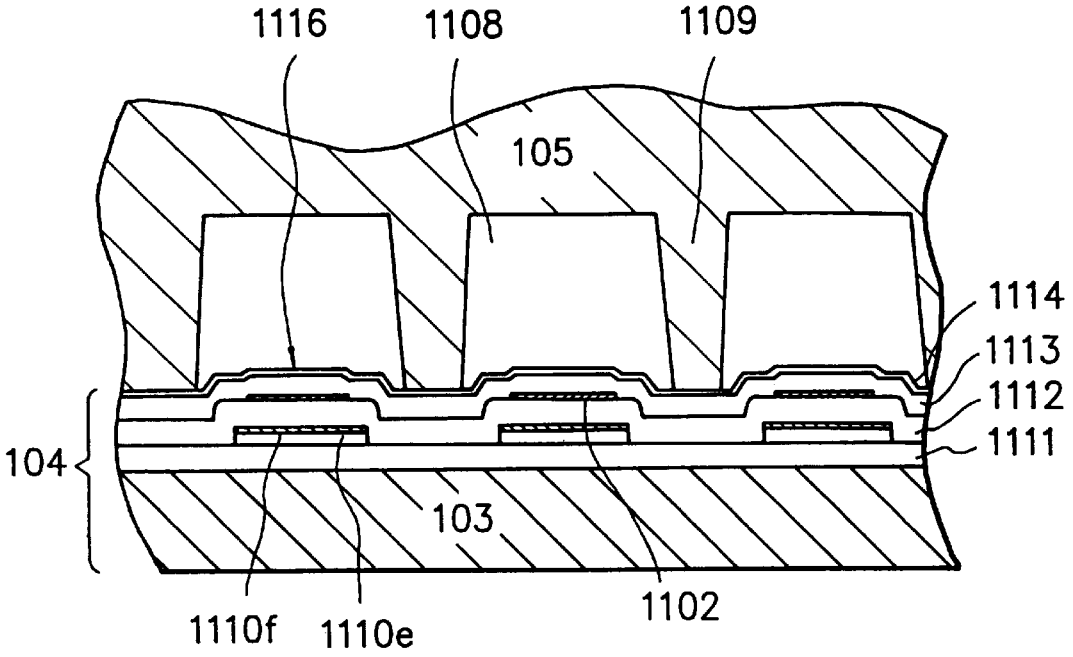
FIG. 4A is a schematic sectional view seen from the same direction as in FIG. 1B, showing a main portion of an ink jet head according to another embodiment of the present invention.
Figure 4B:
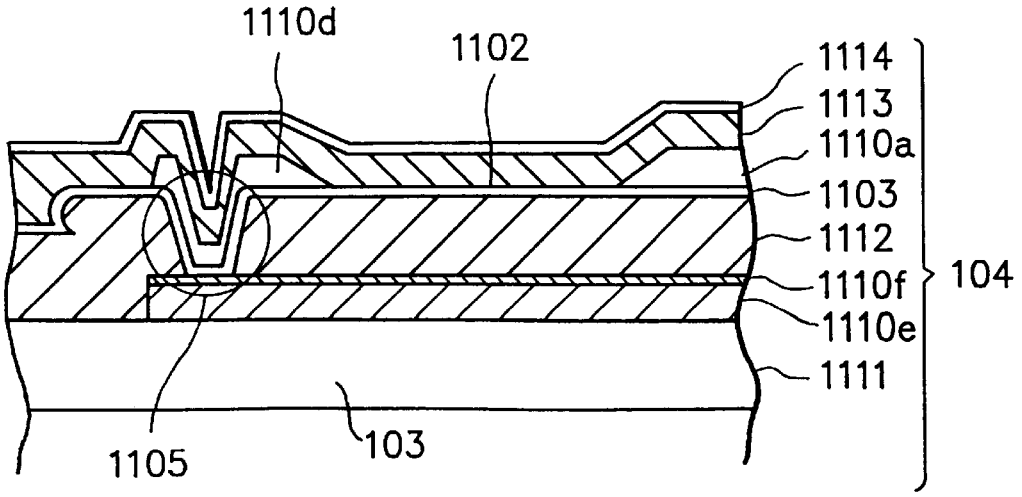
FIG. 4B is a schematic sectional view seen from the same direction in FIG. 1C, showing the main portion of the ink jet head in FIG. 4A.

FIG. 4A is a schematic sectional view of a main portion of another embodiment of the ink jet head, as seen from the same direction in FIG. 1A; and FIG. 4B is a schematic sectional view of the main portion shown in FIG. 4A, as seen from the same direction in FIG. 1B.

This embodiment is different from the previous embodiment in that the electrodes under the upper insulating layer 1112 are formed not as a common conductive layer in a wide and flat shape, but as individually separated conductive layers for each heat generating portion 1102. Each of the electrodes has a multi-layer structure having an upper electrode layer 1110*f* and a lower electrode layer 1110*e*, and the upper electrode layer 1110*f* is formed of a high melting point metal. According to the construction of this substrate for an ink jet head, with respect to the electrode positioned under the heat generating portion 1102 and being most susceptible to the heat generated by the heat generating portion 1102, at least the uppermost layer (upper electrode layer 1110*f*) is made of a high melting point metal, and the high melting point metal layer functions to diffuse the heat and to lower the thermal effect and nevertheless the layer itself is not affected by the heat. Accordingly, it becomes possible to prevent or suppress the generation of a hillock and hence to prevent or suppress the generation of a projecting portion on the bubbling surface.

Moreover, in the ink jet head in this embodiment, since the lower electrodes are independently disposed, the heat generated by each heat generating portion 1102 is prevented from being transmitted to the adjacent heat generating portion by way of the lower electrode. An energy loss due to the thermal diffusion through the lower electrode can be also suppressed.

The substrate for an ink jet head in this embodiment is manufactured by changing the pattern used in the previous embodiment in such a manner that the material layers of the electrode layers are separately and independently patterned.

Figure 5A:
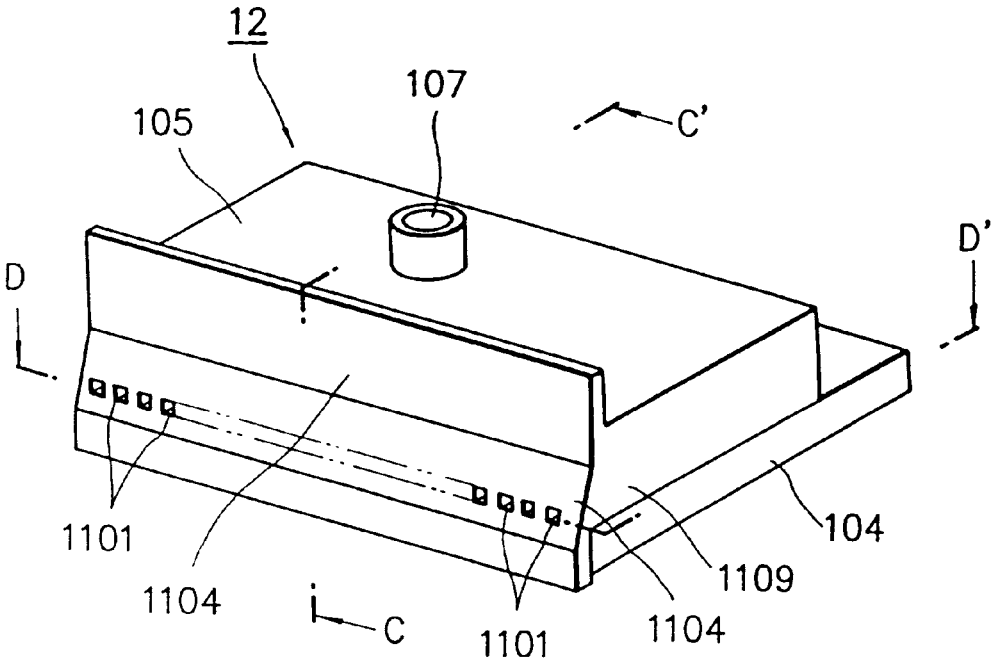
FIG. 5A is a schematic perspective view of a further embodiment of the ink jet head of the present invention.
Figure 5B:
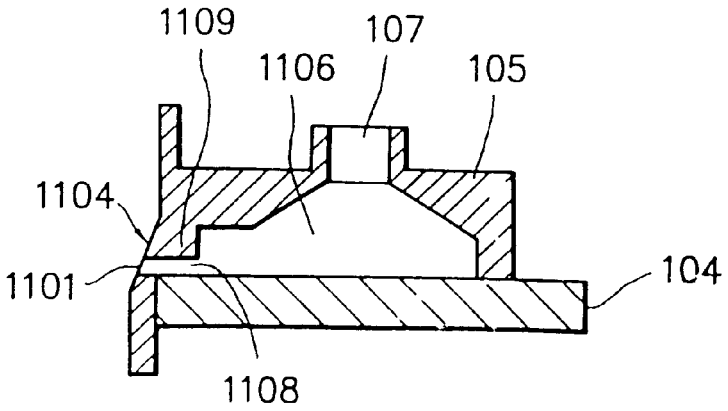
FIG. 5B is a schematic sectional view taken along line C-C' of FIG. 5A, showing the ink jet head.

FIG. 5A is a schematic perspective view showing one embodiment of an ink jet head according to the present invention. FIG. 5B is a schematic sectional view taken along line C-C' of the ink jet head shown in FIG. 5A. In addition, the main portion of the schematic sectional view taken along line D-D' of the ink jet head shown in FIG. 5A is equivalent to that shown in FIG. 1A.

An ink jet head 12 is so constructed that a resin-made top plate 105 is pressingly joined to a substrate 104 for an ink jet head by using an elastic member such as a spring. The top plate 105 includes a discharge opening plate 1104 provided with discharge openings 1101, and a path wall member 1109 integrated with the discharge opening plate 1104. A common ink chamber 1106 is provided in the top plate 105. Ink is supplied from an ink tank for reserving ink to the common ink chamber 1106 by way of a supply opening 107. The ink supplied to the common ink chamber 1106 is introduced into each ink path 1108, and is held in that state that meniscus is formed at the discharge opening 1101. When the electrothermal converting body is driven for generating heat, a change in the state including the film-boiling of ink occurs in ink, to thus form a bubble. On the basis of the growth of the bubbles, the ink is discharged from the discharge opening 1101.

Figure 6:
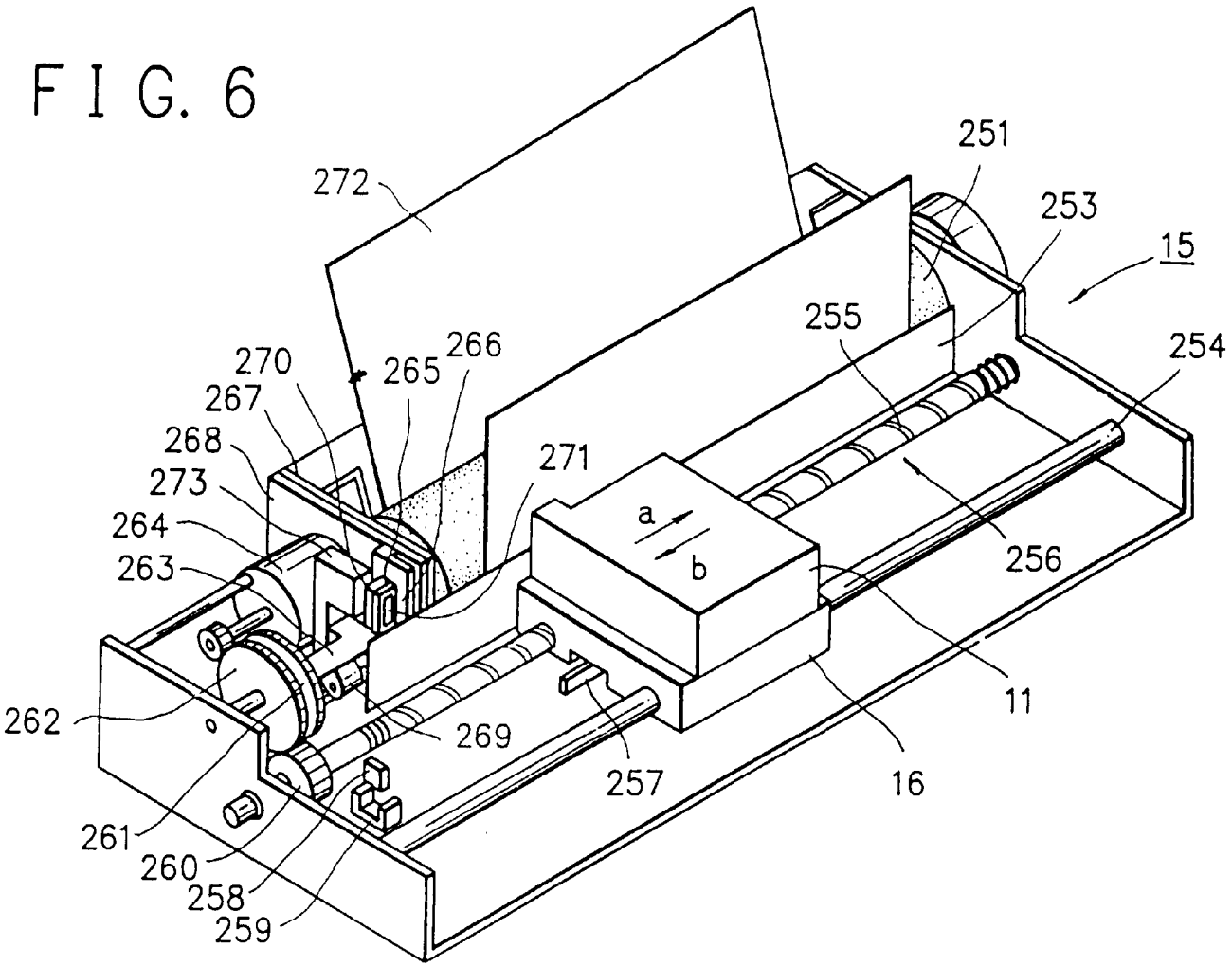
FIG. 6 is a schematic perspective view showing a main portion of an ink jet apparatus mounting an ink jet pen in a cartridge form assembled with the ink jet head shown in FIGS. 5A and 5B.

FIG. 6 is a schematic perspective view showing a main portion of an ink jet apparatus 15 on which an ink jet pen in a cartridge form assembled with the ink jet head shown in FIGS. 5A and 5B is mounted.

As a drive motor 264 is normally or reversely rotated by way of drive force transmission gears 262, 260, a lead screw 256 is rotated. Since a pin (not shown) engaged with a screw groove 255 of the lead screw 256 is provided on a carriage 16, the carriage 16 is reciprocated in the directions shown by the arrows "a" and "b" along with the rotation of the lead screw 256. Reference numeral 253 indicates a paper pressing plate, which presses a paper sheet 272 against a platen 251 in the moving direction of the carriage 16. Reference numeral 258 and 259 indicate a photo-coupler which acts as a home position detecting means for confirming the presence of a lever 257 of the carriage 16 in this range and switching the rotational direction of the motor 264. Reference numeral 11 indicates an ink jet pen of a cartridge type integrally provided with an ink tank. Reference numeral 265 indicates a cap for capping the ink discharge opening of the ink jet pen. The cap 265 is supported by a supporting member 270. Reference numeral 273 indicates a suction means for performing the suction from the ink discharge opening by way of the cap 265 and for sucking and recovering the head by way of an opening 271 of the cap 265. Reference numeral 266 indicates a blade for cleaning the surface on which the ink discharge opening is provided. Reference numeral 268 indicates a member for moving the blade 266 in the longitudinal direction. These are supported on the main body supporting plate 267.

The present invention will be more clearly understood with reference to the following examples.

EXAMPLE 1

A plurality of substrates for ink jet heads shown in FIGS. 1A, 1B and 1C were fabricated in the following procedure.

A 1.5 $\mu$m thick lower insulating layer 1111 made of silicon oxide was formed on a base member 103 made of single crystal silicon by thermal oxidation. On the lower insulating layer 111, a 5,500Å thick Al layer and a 2,000Å thick Ta layer were sequentially formed by continuous sputtering. In this case, the Ta layer was formed so as to be applied with a compressive stress of $5\times10^9$ dyn/cm$^2$ by adjusting argon pressure upon sputtering at 1.8 Pa. The Al layer and Ta layer were simultaneously patterned by dry-etching using a mixed gas of $BCl_3$(46%), $Cl_2$(36%) and $N_2$(18%), thus forming a lower electrode layer 1110*b* made of Al and an upper electrode layer 1110*c* made of Ta formed thereon shown in FIGS. 1B and 1C. Next, a 1.4 $\mu$m thick upper insulating layer 1112 made of silicon oxide was formed by plasma CVD, and then etched using ammonium fluoride, to form contact through-holes 1105. A 600Å thick tantalum nitride layer was formed by sputtering, and patterned by etching, thus forming a resistor layer 1103 having a shape shown in FIG. 1. On the resistor layer 1103, a 5,500Å thick pure Al layer was formed by sputtering, and patterned by etching, thus forming individual electrodes 1110*a* and connection electrodes 1110*d* shown in FIG. 1A. Moreover, a 1.0 μm thick lower protective layer made of silicon oxide was formed by plasma CVD. On the lower protective layer, a 2,300Å thick upper protective layer 1114 made of Ta was formed by sputtering.

A top plate 105 made of polysulfone was pressingly joined to each of a plurality of the substrates 10 for ink jet heads thus manufactured by using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 2

A plurality of substrates for ink jet heads shown in FIGS. 1A, 1B and 1C were manufactured in the same manner as in Example 1, except that the material of the upper electrode layer was changed from Ta to W. Namely, a 5,500Å thick Al layer and a 2,000Å thick W layer were sequentially formed by continuous sputtering. In this case, the W layer was formed so as to be applied with a compressive stress of $5\times10^9$ dyn/cm$^2$ by adjusting the argon pressure upon sputtering at the same value as that of Example 1. The Al layer and W layer were simultaneously patterned by dry-etching in the same manner as in Example 1, thus forming a lower electrode layer 1110*b* made of Al and an upper electrode layer 1110*c* made of W formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 3

A plurality of substrates for ink jet heads shown in FIGS. 1A, 1B and 1C were manufactured in the same manner as in Example 1, except that the material of the upper electrode layer was changed from Ta to Cr. Namely, a 5,500Å thick Al layer and a 2,000Å thick Cr layer were sequentially formed by continuous sputtering. In this case, the Cr layer was formed so as to be applied with a compressive stress of $5\times10^9$ dyn/cm$^2$ by adjusting argon pressure upon sputtering at the same value as that of Example 1. The Al layer and Cr layer were simultaneously patterned by dry-etching in the same manner as in Example 1, thus forming a lower electrode layer 1110*b* made of Al and an upper electrode layer 1110*c* made of Cr formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 4

A plurality of substrates for ink jet heads shown in FIGS. 1A, 1B and 1C were manufactured in the same manner as in Example 1, except that the material of the upper electrode layer was changed from Ta to Ti. Namely, a 5,500Å thick Al layer and a 2,000Å thick Ti layer were sequentially formed by continuous sputtering. In this case, the Ti layer was formed so as to be applied with a compressive stress of $5\times10^9$ dyn/cm$^2$ by adjusting argon pressure upon sputtering at the same value as that of Example 1. The Al layer and Ti layer were simultaneously patterned by dry-etching in the same manner as in Example 1, thus forming a lower electrode layer 1110*b* made of Al and an upper electrode layer 1110*c* made of Ti formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 5

A plurality of substrates for ink jet heads shown in FIGS. 1A, 1B and 1C were manufactured in the same manner as in Example 1, except that the material of the upper electrode layer was changed from Ta to Mo. Namely, a 5,500Å thick Al layer and a 2,000Å thick Mo layer were sequentially formed by continuous sputtering. In this case, the Mo layer was formed so as to be applied with a compressive stress of $5\times10^9$ dyn/cm$^2$ by adjusting argon pressure upon sputtering at the same value as that of Example 1. The Al layer and Mo layer were simultaneously patterned by dry-etching in the same manner as in Example 1, thus forming a lower electrode layer 1110*b* made of Al and an upper electrode layer 1110*c* made of Mo formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 6

A plurality of substrates for ink jet heads shown in FIGS. 1A, 1B and 1C were manufactured in the same manner as in Example 1, except that the material of the upper electrode layer was changed from Ta to Ti—Mo. Namely, a 5,500Å thick Al layer and a 2,000Å thick Ti—Mo alloy (Mo: 5%, the balance: Ti) layer were sequentially formed by continuous sputtering. In this case, the Ti—Mo alloy layer was formed so as to be applied with a compressive stress of $5\times10^9$ dyn/cm$^2$ by adjusting argon pressure upon sputtering at the same value as that of Example 1. The Al layer and Ti—Mo alloy layer were simultaneously patterned by dry-etching in the same manner as in Example 1, thus forming a lower electrode layer 1110*b* made of Al and an upper electrode layer 1110*c* made of Ti—Mo formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 7

A plurality of substrates for ink jet heads shown in FIGS. 1A, 1B and 1C were manufactured in the same manner as in Example 1, except that the material of the upper electrode layer was changed from Ta to Ti—Cr. Namely, a 5,500Å thick Al layer and a 2,000Å thick Ti—Cr alloy (Cr: 5%, the balance: Ti) layer were sequentially formed by continuous sputtering. In this case, the Ti—Cr alloy layer was formed so as to be applied with a compressive stress of $5\times10^9$ dyn/cm$^2$ by adjusting argon pressure upon sputtering at the same value as that of Example 1. The Al layer and Ti—Cr alloy layer were simultaneously patterned by dry-etching in the same manner as in Example 1, thus forming a lower electrode layer 1110*b* made of Al and an upper electrode layer 1110*c* made of Ti—Cr alloy formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 8

A plurality of substrates for ink jet heads shown in FIGS. 1A, 1B and 1C were manufactured in the same manner as in Example 1, except that the material of the upper electrode layer was changed from Ta to Ti—Al. Namely, a 5,500Å thick Al layer and a 2,000Å thick Ti—Al alloy (Al: 5%, the balance: Ti) layer were sequentially formed by continuous sputtering. In this case, the Ti—Al alloy layer was formed so as to be applied with a compressive stress of $5\times10^9$ dyn/cm$^2$ by adjusting argon pressure upon sputtering at the same value as that of Example 1. The Al layer and Ti—Al alloy layer were simultaneously patterned by dry-etching in the same manner as in Example 1, thus forming a lower electrode layer 1110*b* made of Al and an upper electrode layer 1110*c* made of Ti—Al alloy formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 9

A plurality of substrates for ink jet heads shown in FIGS. 1A, 1B and 1C were manufactured in the same manner as in Example 1, except that the material of the lower electrode layer was changed from Al to Cu. Namely, a 5,500 Å thick Cu layer and a 2,000 Å thick Ta layer were sequentially formed by continuous sputtering. In this case, the Ta layer was formed so as to be applied with a compressive stress of $5\times10^9$ dyn/cm$^2$ by adjusting argon pressure upon sputtering at the same value as that of Example 1. The Cu layer and Ta layer were simultaneously patterned by dry-etching in the same manner as in Example 1, thus forming a lower electrode layer 1110*b* made of Cu and an upper electrode layer 1110*c* made of Ta formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 10

A plurality of substrates for ink jet heads shown in FIGS. 1A, 1B and 1C were manufactured in the same manner as in Example 1, except that the material of the lower electrode layer was changed from Al to Al—Si alloy. Namely, a 5,500 Å thick Al—Si alloy (Si: 10%, the balance: Al) layer and a 2,000 Å thick Ta layer were sequentially formed by continuous sputtering. In this case, the Ta layer was formed so as to be applied with a compressive stress of $5\times10^9$ dyn/cm$^2$ by adjusting argon pressure upon sputtering at the same value as that of Example 1. The Al—Si alloy layer and Ta layer were simultaneously patterned by dry-etching in the same manner as in Example 1, thus forming a lower electrode layer 1110*b* made of Al—Si alloy and an upper electrode layer 1110*c* made of Ta formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 11

A plurality of substrates for ink jet heads shown in FIGS. 1A, 1B and 1C were manufactured in the same manner as in Example 1, except that the material of the lower electrode layer was changed from Al to Al—Cu alloy. Namely, a 5,500 Å thick Al—Cu alloy (Cu: 10%, the balance: Al) layer and a 2,000 Å thick Ta layer were sequentially formed by continuous sputtering. In this case, the Ta layer was formed so as to be applied with a compressive stress of $5\times10^9$ dyn/cm$^2$ by adjusting argon pressure upon sputtering at the same value as that of Example 1. The Al—Cu alloy layer and Ta layer were simultaneously patterned by dry-etching in the same manner as in Example 1, thus forming a lower electrode layer 1110*b* made of Al—Cu alloy and an upper electrode layer 1110*c* made of Ta formed thereon shown in FIGS. 1B and 1C.

A top plate 105 made of polysulfone was pressingly joined to each of a plurality of the substrates 10 for ink jet heads thus manufactured using a spring (not shown). Thus, a plurality of the ink jet heads 12 shown in FIGS. 5A and 5B were obtained. In this ink jet head 12, the arrangement density of the discharge openings 1101 was set at 16 nozzles/mm, and the number of the discharge openings 1101 was set at 128 nozzles.

EXAMPLE 12

A plurality of substrates for ink jet heads shown in FIGS. 4A and 4B were manufactured in the same manner as in Example 1, except that the process of patterning the lower electrode material layer and upper electrode material layer by etching was changed as follows. Namely, different from Example 1, the Al layer and Ta layer were patterned by dry-etching on the basis of such a pattern that the lower electrode layers 1110*e* made of Al and the upper electrode layers 1110*f* made of Ta were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 13

A plurality of substrates for ink jet heads shown in FIGS. 4A and 4B were manufactured in the same manner as in Example 2, except that the process of patterning the lower electrode material layer and upper electrode material layer by etching was changed as follows. Namely, different from Example 2, the Al layer and W layer were patterned by dry-etching on the basis of such a pattern that the lower electrode layers 1110*e* made of Al and the upper electrode layers 1110*f* made of W were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 14

A plurality of substrates for ink jet heads shown in FIGS. 4A and 4B were manufactured in the same manner as in Example 3, except that the process of patterning the lower electrode material layer and upper electrode material layer by etching was changed as follows. Namely, different from Example 3, the Al layer and Cr layer were patterned by dry-etching on the basis of such a pattern that the lower electrode layers 1110*e* made of Al and the upper electrode layers 1110*f* made of Cr were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 15

A plurality of substrates for ink jet heads shown in FIGS. 4A and 4B were manufactured in the same manner as in Example 4, except that the process of patterning the lower electrode material layer and upper electrode material layer by etching was changed as follows. Namely, different from Example 4, the Al layer and Ti layer were patterned by dry-etching on the basis of such a pattern that the lower electrode layers 1110*e* made of Al and the upper electrode layers 1110*f* made of Ti were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 16

A plurality of substrates for ink jet heads shown in FIGS. 4A and 4B were manufactured in the same manner as in Example 5, except that the process of patterning the lower electrode material layer and upper electrode material layer by etching was changed as follows. Namely, different from Example 5, the Al layer and Mo layer were patterned by dry-etching on the basis of such a pattern that the lower electrode layers 1110*e* made of Al and the upper electrode layers 1110*f* made of Mo were separately and independently formed as shown in FIGS. 4A and 4G.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 17

A plurality of substrates for ink jet heads shown in FIGS. 4A and 4B were manufactured in the same manner as in Example 6, except that the process of patterning the lower electrode material layer and upper electrode material layer by etching was changed as follows. Namely, different from Example 6, the Al layer and Ti—Mo alloy layer were patterned by dry-etching on the basis of such a pattern that the lower electrode layers 1110*e* made of Al and the upper electrode layers 1110*f* made of Ti—Mo alloy were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 18

A plurality of substrates for ink jet heads shown in FIGS. 4A and 4B were manufactured in the same manner as in Example 7, except that the process of patterning the lower electrode material layer and upper electrode material layer by etching was changed as follows. Namely, different from Example 7, the Al layer and Ti—Cr alloy layer were patterned by dry-etching on the basis of such a pattern that the lower electrode layers 1110*e* made of Al and the upper electrode layers 1110*f* made of Ti—Cr alloy were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 19

A plurality of substrates for ink jet heads shown in FIGS. 4A and 4B were manufactured in the same manner as in Example 8, except that the process of patterning the lower electrode material layer and upper electrode material layer by etching was changed as follows. Namely, different from Example 8, the Al layer and Ti—Al alloy layer were patterned by dry-etching on the basis of such a pattern that the lower electrode layers 1110*e* made of Al and the upper electrode layers 1110*f* made of Ti—Al alloy were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 20

A plurality of substrates for ink jet heads shown in FIGS. 4A and 4B were manufactured in the same manner as in Example 9, except that the process of patterning the lower electrode material layer and upper electrode material layer by etching was changed as follows. Namely, different from Example 9, the Cu layer and Ta alloy layer were patterned by dry-etching on the basis of such a pattern that the lower electrode layers 1110*e* made of Cu and the upper electrode layers 1110*f* made of Ta alloy were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 21

A plurality of substrates for ink jet heads shown in FIGS. 4A and 4B were manufactured in the same manner as in Example 10, except that the process of patterning the lower electrode material layer and upper electrode material layer by etching was changed as follows. Namely, different from Example 10, the Al—Si alloy layer and Ta alloy layer were patterned by dry-etching on the basis of such a pattern that the lower electrode layers 1110*e* made of Al—Si alloy and the upper electrode layers 1110*f* made of Ta alloy were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EXAMPLE 22

A plurality of substrates for ink jet heads shown in FIGS. 4A and 4B were manufactured in the same manner as in Example 11, except that the process of patterning the lower electrode material layer and upper electrode material layer by etching was changed as follows. Namely, different from Example 11, the Al—Cu alloy layer and Ta alloy layer were patterned by dry-etching on the basis of such a pattern that the lower electrode layers 1110*e* made of Al—Cu alloy and the upper electrode layers 1110*f* made of Ta alloy were separately and independently formed as shown in FIGS. 4A and 4B.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

COMPARATIVE EXAMPLE

Figure 2A:
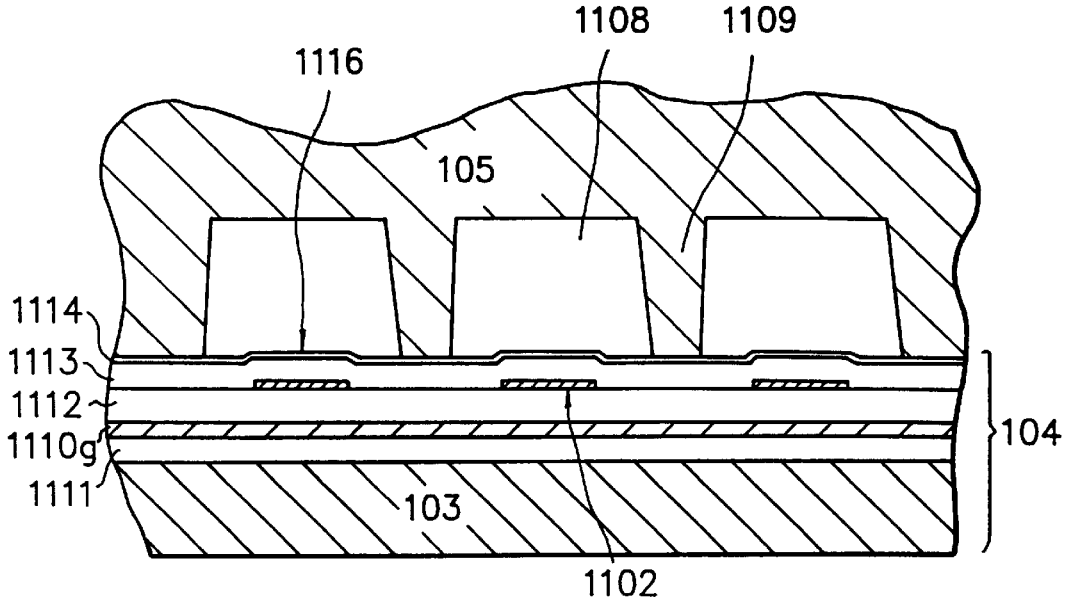
FIG. 2A is a schematic sectional view seen from the same direction as in FIG. 1B, showing a main portion of a background art ink jet head.
Figure 2B:
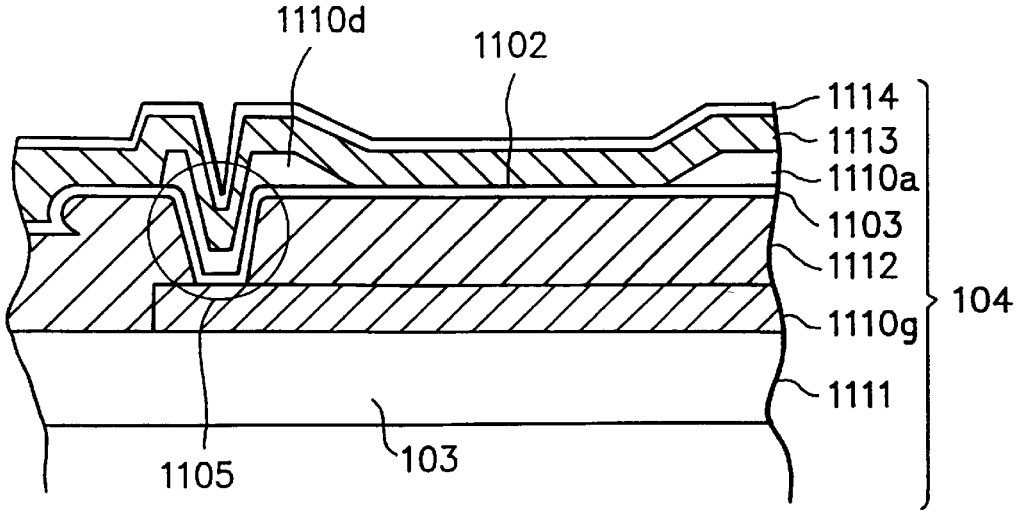
FIG. 2B is a schematic sectional view seen from the same direction as in FIG. 1C, showing the main portion of the background art ink jet head.

A plurality of substrates for ink jet heads shown in FIGS. 2A and 2B were manufactured in the same manner as in Example 1, except that the process of forming the lower electrode layer and upper electrode layer was changed as follows. Namely, a 7,500 Å thick pure Al layer was formed by sputtering, and patterned by dry-etching using the same gas as that in Example 1, thus forming an electrode layer 1110*g* having a single layer structure of Al.

A top plate 105 made of polysulfone was pressingly joined to each of a plurality of the substrates 10 for ink jet head according to the embodiment thus manufactured using a spring (not shown). Thus, a plurality of the ink jet heads 12 according to the embodiment shown in FIGS. 5A and 5B were obtained. The density in arrangement of the discharge openings 1101 of the ink jet head 12 was set at 16 nozzles/mm, and the number of the discharge openings 1101 was 128 nozzles.

EVALUATION

Each of the ink jet heads 12 obtained in Example 1 and Comparative Example was assembled in the ink jet pen 11, and the ink jet pen 11 was mounted on the ink jet apparatus shown in FIG. 6. The discharge endurance test for each ink jet head was made by performing ink discharge using the above ink jet apparatus 15.

Figure 3:
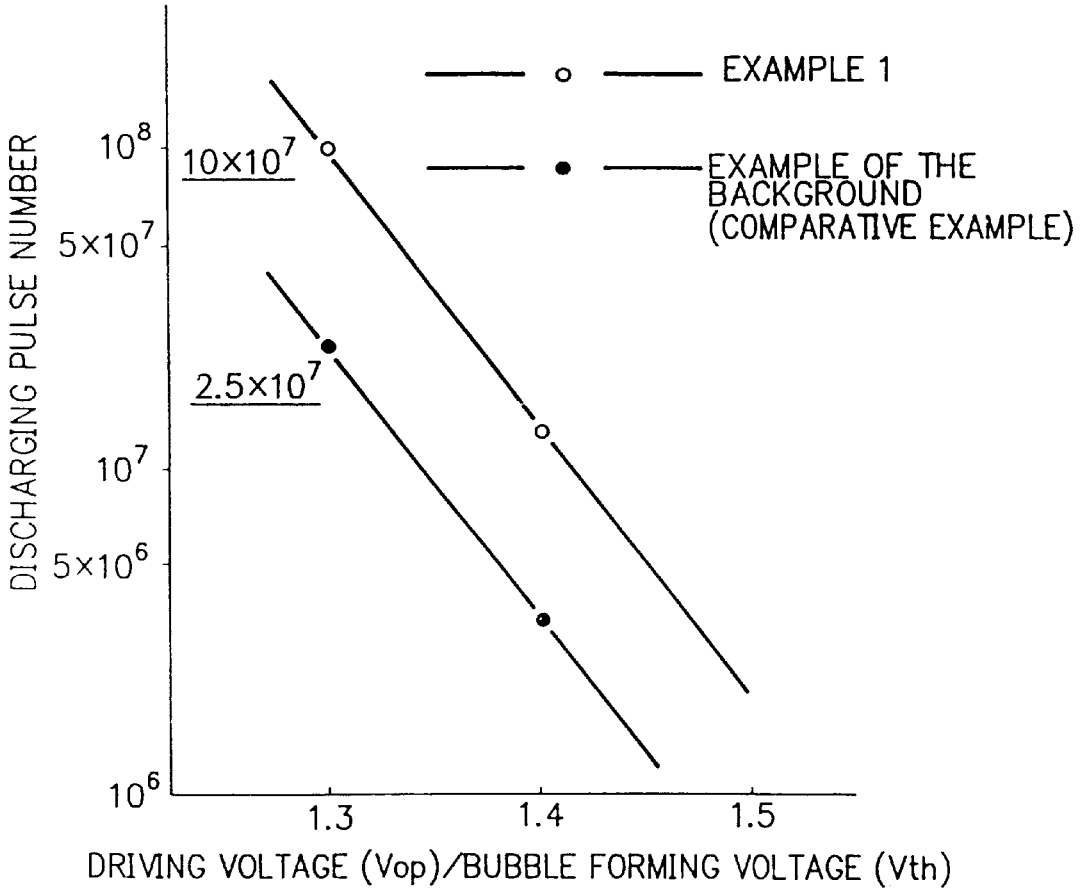
FIG. 3 is a graph for comparing an ink jet head of a first example with the background art ink jet head in discharge endurance performance.

FIG. 3 is a graph for comparing the ink jet head of Example 1 with that of Comparative Example (Background Art) in the discharge endurance performance. In the graph of FIG. 3, the ordinate indicates the discharging pulse number, and the abscissa indicates the input energy amount in driving voltage (Vop)/bubble forming voltage (Vth). Namely, the graph shows the number of the discharging pulse indicated along the ordinate at the time when either of the heat generators is broken in accordance with an input energy amount indicated along the abscissa. With respect to each of Example 1 and Comparative Example, 10 pieces of ink jet heads were tested, and the average value thereof was plotted in the graph shown in FIG. 3. In this test, the width of the discharging pulse was 5 $\mu$s.

As is apparent from FIG. 3, the ink jet head in Example 1 exhibits an excellent durability which is about four times that of the ink jet head in Comparative Example.

The ink jet heads in Example 1 and Comparative Example were disassembled for the same discharging pulse number, and the state of the bubbling surface was observed. As a result, it was confirmed that in the ink jet head in Example 1, the presence of projecting portions was little observed on the bubbling surface, as compared with the ink jet head in Comparative Example.

The ink jet heads in the other examples were similarly subjected to comparative test. As a result, it was confirmed that each of the other examples showed the excellent performance similar to that of Example 1.

What we claim is:

1. A substrate for an ink jet head comprising a base member and an electrothermal converting body formed on the base member, said electrothermal converting body including a resistor layer and a pair of electrode layers connected to said resistor layer, said resistor layer having a portion positioned between said pair of electrode layers, said portion serving as a heat generating portion for generating a thermal energy utilized for discharging ink, wherein one of said pair of electrode layers passes under said heat generating portion; the electrode layer positioned under the heat generating portion has a multi-layered structure comprising a plurality of layers which are stacked, an uppermost layer of said plurality of layers that is nearest to the heat generating portion is made of a metal having a melting point of 1500° C. or more at 1 atm, and an insulating layer is provided between said resistor layer and said uppermost layer.

2. A substrate for an ink jet head according to claim 1, wherein said metal has a melting point of 2500° C. or more at 1 atm.

3. A substrate for an ink jet head according to claim 1, wherein said metal is Ta, W, Cr, Ti, Mo, or an alloy containing at least two or more metals selected from a group of consisting of Ta, W, Cr, Ti and Mo.

4. A substrate for an ink jet head according to claim 1, wherein said metal is an alloy containing at least one metal selected from a group consisting of Ta, W, Cr, Ti and Mo.

5. A substrate for an ink jet head according to claim 1, wherein said uppermost layer is formed to be applied with a compressive stress.

6. A substrate for an ink jet head according to claim 1, wherein one of said plurality of layers situated under said uppermost layer is made of a metal having a melting point less than 1500° C. at 1 atm.

7. A substrate for an ink jet head according to claim 1, wherein one of said plurality of layers situated under said uppermost layer is made of Al, Cu, an Al—Si alloy, or an Al—Cu alloy.

8. An ink jet pen comprising:

an ink jet head including: a substrate for an ink jet head, comprising a base member and an electrothermal converting body formed on the base member, said electrothermal converting body including a resistor layer and a pair of electrode layers connected to said resistor layer, said resistor layer having a portion positioned between said pair of electrode layers, said portion serving as a heat generating portion for generating a thermal energy utilized for discharging ink; an ink path disposed to correspond to said heat generating portion; and a discharge opening for discharging ink, which is communicated with said ink path; and an ink reservoir for reserving ink to be supplied to said ink path;

wherein one of said pair of electrode layers passes under said heat generating portion; the electrode layer positioned under the heat generating portion has a multi-layered structure comprising a plurality of layers which are stacked, an uppermost layer of said plurality of layers that is nearest to the heat generating portion is made of a metal having a melting point of 1500° C. or more at 1 atm, and an insulating layer is provided between said resistor layer and said uppermost layer.

9. A substrate for an ink jet head according to claim 1, wherein said insulating layer is made of silicon oxide or silicon nitride.

10. A substrate for an ink head according to claim 1, wherein a plurality of said heat generating portions are provided.

11. A substrate for an ink jet head according to claim 1, wherein each of the layers of the multi-layered structure has a pattern, and said patterns are all identical.

12. A substrate for an ink jet head according to claim 10, wherein the plurality of layers of the multi-layered structure constitute a common lead electrode provided in common to the plurality of the heat generating portions.

13. A substrate for an ink jet head according to claim 10, wherein at least more than one of said layers are separately and independently provided to correspond to a plurality of said heat generating portions.

14. A substrate for an ink jet head according to claim 1, wherein at least the surface of said base member is insulating.

15. A substrate for an ink jet head according to claim 1, wherein a protective layer is formed on said electrothermal converting body.

16. An ink jet head comprising:

a substrate for an ink jet head, including a base member and an electrothermal converting body formed on said base member, said electrothermal converting body including a resistor layer and a pair of electrode layers connected to said resistor layer, said resistor layer having a portion positioned between said pair of electrode layers, said portion serving as a heat generating portion for generating thermal energy utilized for discharging ink;

an ink path disposed to correspond to said heat generating portion; and a discharge opening for discharging ink, which is communicated with said ink path;

wherein one of said pair of electrode layers passes under said heat generating portion; the electrode layer positioned under the heat generating portion has a multi-layered structure comprising a plurality of layers which are stacked, an uppermost layer of said plurality of layers that is nearest to the heat generating portion is made of a metal having a melting point of 1500° C. or more at 1 atm, and an insulating layer is provided between said resistor layer and said uppermost layer.

17. An ink jet head according to claim 16, wherein said metal has a melting point of 2500° C. or more at 1 atm.

18. An ink jet head according to claim 16, wherein said metal is Ta, W, Cr, Ti, Mo, or an alloy containing at least two or more metals selected from a group of consisting of Ta, W, Cr, Ti and Mo.

19. An ink jet head according to claim 16, wherein said metal is an alloy containing at least one metal selected from a group consisting of Ta, W, Cr, Ti and Mo.

20. An ink jet head according to claim 16, wherein said uppermost layer is formed to be applied with a compressive stress.

21. An ink jet head according to claim 16, wherein one of said plurality of layers situated under said uppermost layer is made of a metal having a melting point less than 1500° C. at 1 atm.

22. An ink jet head according to claim 16, wherein one of said plurality of layers situated under said uppermost layer is made of Al, Cu, an Al—Si alloy, or an Al—Cu alloy.

23. An ink jet apparatus comprising:

an apparatus body;

an ink jet head including: a substrate for an ink jet head, comprising a base member and an electrothermal converting body formed on the base member, said electrothermal converting body including a resistor layer and a pair of electrode layers connected to said resistor layer, said resistor layer having a portion positioned between said pair of electrode layers, said portion serving as a heat generating portion for generating a thermal energy utilized for discharging ink; and ink path disposed to correspond to said heat generating portion; and a discharge opening for discharging ink, which is communicated with said ink path; and a means for mounting said ink jet head in the apparatus body;

wherein one of said pair of electrode layers passes under said heat generating portion; the electrode layer positioned under the heat generating portion has a multi-layered structure comprising a plurality of layers that are stacked, an uppermost layer of said plurality of layers that is nearest to the heat generating portion is made of a metal having a melting point of 1500° C. or more at 1 atm, and an insulating layer is provided between said resistor layer and said uppermost layer.

24. An ink jet head according to claim 16, wherein said insulating layer is made of silicon oxide or silicon nitride.

25. An ink jet head according to claim 16, wherein a plurality of said heat generating portions are provided, and a plurality of said heat generating portions are provided to correspond to a plurality of said discharge openings respectively.

26. An ink jet head according to claim 16, wherein the layer of the multi-layered structure which is the nearest to the heat generating portion has a pattern, and each of the remaining layers of the multi-layered structure has a pattern, and said patterns are all identical.

27. An ink jet head according to claim 25, wherein the plurality of layers of the multi-layered structure constitute a common lead electrode provided in common to the plurality of the heat generating portions.

28. An ink jet head according to claim 25, wherein the plurality of layers of the multi-layered structure are separately and independently provided to correspond to the plurality of the heat generating portions respectively.

29. An ink jet head according to claim 16, wherein the base member has at least an insulating surface and the electrothermal converting body is provided on said insulating surface of the base member.

30. An ink jet head according to claim 16, wherein a protective layer is formed on said electrothermal converting body.

* * * * *

UNITED STATES PATENT AND TRADEMARK OFFICE

CERTIFICATE OF CORRECTION

PATENT NO. : 6,056,391

DATED : May 2, 2000

INVENTOR(S) : MASAMI KASAMOTO ET AL

It is certified that error appears in the above-identified patent and that said Letters Patent is hereby corrected as shown below:

ON THE TITLE PAGE:

Insert: --[*] Notice: This patent issued on a continued prosecution application filed under 37 CFR 1.53(d), and is subject to the twenty year patent term provisions of 35 U.S.C. 154(a)(2).--; and

[56] References Cited, under OTHER PUBLICATIONS

After "Lewis," "12thed," should read --12th ed.,--.

COLUMN 2:

Line 38, "lief" should read --life--.

COLUMN 3:

Line 34, "at lest" should read --at least--.

COLUMN 6:

Line 2, "An" should read --A--; and
Line 5, "108" should read --1108--.

COLUMN 10:

Line 54, "Ti-Mo." should read --Ti-Mo alloy.--.

UNITED STATES PATENT AND TRADEMARK OFFICE

CERTIFICATE OF CORRECTION

PATENT NO. : 6,056,391

DATED : May 2, 2000

INVENTOR(S) : MASAMI KASAMOTO ET AL

It is certified that error appears in the above-identified patent and that said Letters Patent is hereby corrected as shown below:

COLUMN 14:

Line 27, "4G." should read --4B.--.

COLUMN 17:

Line 49, "of" (first occurrence) should be deleted.

COLUMN 18:

Line 24, "ink head" should read --ink jet head--.

COLUMN 19:

Line 5, "of" (first occurrence) should be deleted.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*